US006010834A

United States Patent [19]

McGuckin et al.

[11] Patent Number: 6,010,834

[45] Date of Patent: Jan. 4, 2000

[54] PHOTOGRAPHIC FINAL RINSE PROCESSING SOLUTION AND METHOD OF USE

[75] Inventors: Hugh G. McGuckin, Rochester; John S. Badger, Webster; Brad M. Boersen, Rochester, all of N.Y.

[73] Assignee: Eastman Kodak Company, Rochester, N.Y.

[21] Appl. No.: 09/286,768

[22] Filed: Apr. 6, 1999

Related U.S. Application Data

[62] Division of application No. 09/018,627, Feb. 4, 1998, Pat. No. 5,952,158.

[51] Int. Cl.[7] ..... G03C 7/392

[52] U.S. Cl. ..... 430/463

[58] Field of Search ..... 430/463

[56] References Cited

U.S. PATENT DOCUMENTS

| | | | |
|---|---|---|---|
| 3,369,896 | 2/1968 | Seemann et al. | 430/463 |
| 3,545,970 | 12/1970 | Giorgianni et al. | 430/376 |
| 4,537,856 | 8/1985 | Kurematsu et al. | 430/372 |
| 4,840,877 | 6/1989 | Abe et al. | 430/372 |
| 5,534,396 | 7/1996 | McGuckin et al. | 430/463 |
| 5,645,980 | 7/1997 | McGuckin et al. | 430/463 |
| 5,667,948 | 9/1997 | McGuckin et al. | 430/463 |
| 5,716,765 | 2/1998 | McGuckin et al. | 430/463 |
| 5,750,322 | 5/1998 | McGuckin et al. | 430/463 |

FOREIGN PATENT DOCUMENTS

| | | |
|---|---|---|
| 91/05289 | 9/1989 | WIPO . |

*Primary Examiner*—Hoa Van Le
*Attorney, Agent, or Firm*—J. Lanny Tucker

[57] ABSTRACT

Color photographic materials are processed using a final rinse solution containing a water-soluble or water-dispersible glycol, and a mixture of specific surfactants. One surfactant is a nonionic polyethoxylated, nonfluorinated compound, or an anionic non-fluorinated sulfate or sulfonate, and the second surfactant is a nonionic or anionic fluorinated compound. This solution provides processed materials, with or without a magnetic backing layer, that are free of scum or other residues, non-tacky, and resistant to abrasion and fingerprinting. The final rinse solution can be provided in concentrated form, particularly because the glycol is included.

24 Claims, No Drawings

PHOTOGRAPHIC FINAL RINSE PROCESSING SOLUTION AND METHOD OF USE

This application is a Rule 1.53(b) divisional of allowed U.S. Ser. No. 09/018,627, filed Feb. 4, 1998, U.S. Pat No. 5,592,158.

RELATED APPLICATION

Copending and commonly assigned U.S. Ser. No. 09/018,579 filed by McGuckin, Badger, Boersen and Horn, on even date herewith and entitled "Photographic Stabilizing Processing Solution and Method of Use."

FIELD OF THE INVENTION

This invention relates in general to photography, and more particularly, it relates to an improved photographic final rinse solution, and to a method of processing photographic silver halide materials, such as color negative and color reversal films, using that solution.

BACKGROUND OF THE INVENTION

During the processing of photographic materials, one or more rinsing or washing steps may be used to remove residual processing solution from the materials prior to contact with the next processing solution. Moreover, before processed materials are dried, they are generally washed a last time to remove all remaining chemical residues so that when they are dried, they are free of lines, water spots or scum. For example, in processing most films and papers (both color and black and white), a final rinsing or stabilizing step is used prior to drying.

Many different formulations have been proposed for use as final rinse solutions in photographic processes immediately prior to drying. Generally, they include one or more surfactants that facilitate the "cleaning" of the photographic material and uniform liquid drainage. In addition, rinse solutions can contain one or more biocides to prevent unwanted biological growth in the processing tank or on the photographic material. The solutions may additionally contain calcium ion sequestering agents or polymers such as polyvinylpyrrolidone to reduce precipitation of sulfur or sulfides.

To meet all of the needs of a final rinse solution, a careful formulation of components, generally surfactants and biocides, must be made. Proper balancing is required to keep costs low, minimize foaming and biological growth, while achieving the desired drainage and defect free processing expected by highly critical customers.

Not every final rinse solution useful for processing one type of photographic element may be useful for processing other types of elements. Each type of photographic element may have surface characteristics, or be processed using unique chemicals that require unique final processing solution components. In addition, not every final rinse solution can be successfully used with any type of processing equipment and arrangement.

A conventional final rinse solution useful for processing color motion picture films includes a single nonionic surfactant, such as tridecylpolyethyleneoxide(12) alcohol.

A commercial final rinse solution used to process color negative films is also known to include a nonionic fluorosurfactant in combination with a nonionic nonfluorinated surfactant, and a conventional biocide. This solution acceptably cleans photographic films in roller transport processing machines. However, when it is used to process films in what are known as "rack and tank" processors, it fails to clean acceptably, and leaves what are known as "drying lines" and other defects on the processed films. This problem is particularly evident when films having magnetic backing layers are processed in such processors. Rack and tank processors are designed without squeegees that are present in other types of processors to remove solution from the processed films. Thus, rack and tank processors are the "worst case" processors for any final rinse solution, and if a solution cleans acceptably in rack and tank processors without scum and drying lines on the films, it will likely clean well in any other type of processor.

Thus, there is a continuing need in the art for an improved, low cost, highly effective, final rinse solutions that achieves all of the desired results when various films, especially magnetic layer-backed films, are processed in various processing machines, including rack and tank processors.

SUMMARY OF THE INVENTION

The present invention provides an advance in the art of processing photographic films by providing a photographic final rinse solution comprising:

a) a first surfactant that is:
   - a nonionic polyethoxylated, non-fluorinated surfactant, or
   - an anionic non-fluorinated sulfate or sulfonate surfactant,
   - the first surfactant being present at a concentration of at least 0.03 g/l, b) a second surfactant that is a nonionic or anionic fluorinated surfactant present at a concentration of at least 0.005 g/l, and c) a water-soluble or water-dispersible glycol present at a concentration of at least 0.25 g/l.

This invention also provides a concentrated photographic final rinse solution comprising:

a) the first surfactant described above that is present at a concentration of from about 0.9 to about 600 g/l, b) the second surfactant described above that is present at a concentration of from about 0.15 to about 300 g/l, and c) a water-soluble or water-dispersible glycol that is present at a concentration of from about 7.5 to about 1000 g/l.

Further, this invention provides a method for photographic processing comprising:

treating an imagewise exposed and color developed silver halide photographic material comprising a support and having disposed on one side thereof, a silver halide emulsion layer, with the final rinse solution described above.

Still again, this invention provides a processing method whereby the photographic material is treated with a final rinse solution that is prepared by diluting the concentrated final rinse solution noted above from 30 to 120 times.

The processing method of this invention represents an improvement in the art because the specific final rinse solution of this invention reduces the amount of scum defects on the processed photographic materials. This advantage is particularly evident when the photographic materials are photographic films that are processed in various processors, including what are known as "rack and tank" processors (no squeegees present), or what are known as "rapid access" minilab processors (low volumes and shortened process times).

The photographic films, particularly those having a magnetic backing layer, processed using this invention show reduced residue (scum) and drying lines, and are non-tacky and resistant to abrasion and fingerprinting. Moreover, the final rinse solutions used in the method can be formulated, packaged and stored in a single concentrated solution when a glycol is included. While not intending to be limited to a specific explanation, it is believed that the glycol solubilizes the other components in the concentrated solution.

This improvement is achieved with a specific combination of first and second surfactants. The first surfactant can be chosen from two different classes of compounds: nonionic polyethoxylated non-fluorinated surfactants, and anionic, non-fluorinated sulfates or sulfonate surfactants. The second surfactant is a nonionic or anionic fluorinated surfactant. The first and second surfactants are combined with one or more water-soluble or water-dispersible glycols, which is a critical component to provide the defect-free processing.

DETAILED DESCRIPTION OF THE INVENTION

The final rinse solutions (working strength or concentrates) of this invention are aqueous solutions generally having a pH of from about 4 to about 10. Preferably, the pH is from about 5 to about 9, and more preferably, it is from about 6.5 to about 8.5. The pH of the concentrated solution may vary somewhat from that of the working strength solution.

The final rinse processing solution can be packaged and transported as a working strength solution, or as a single concentrated composition. It can be used as a replenisher as well as the initial tank working solution. When formulated into concentrated form, the solution can be diluted up to 120 times (preferably from 50 to 70 times) with water or a buffer solution to provide a suitable working strength solution. The level of dilution will depend upon the solubility of the various compounds in the solution.

The first essential surfactant in the final rinse solution is chosen from one or more of the following two classes of compounds.

The first type of compounds includes water-soluble nonionic polyethoxylated non-fluorinated surfactants, or a mixture of such materials. "Nonionic surfactants" refer to surfactants that are not ionized in an aqueous medium. Particularly useful nonionic polyethoxylated non-fluorinated surfactants include, but are not limited to, polyhydric alcohols and hydrocarbon polyethoxylated surfactants having the general formula (I):

$$R—(B)_x—(E)_m—D$$

wherein R is a substituted or unsubstituted alkyl group having 8 to 20 carbon atoms, B is a substituted or unsubstituted phenylene group, x is 0 or 1, E is $—(OCH_2CH_2)—$, m is an integer of 6 to 20, and D is hydroxy or methoxy.

Examples of useful nonionic non-fluorinated surfactants include, but are not limited to,

- octylphenoxypoly(ethyleneoxide)(9) ethanol (available from Union Carbide Co. under the tradename TRITON X-100),
- octylphenoxypolyethyleneoxide(12) ethanol (available from Union Carbide Co. under the tradename TRITON X-102),
- octylphenoxypolyethyleneoxide(30–40) ethanol (available from Union Carbide Co. under the tradename TRITON X-405),
- alkyl($C_{12}$–$C_{15}$ mixture) polyethyleneoxide(7) alcohol (available from Shell Chemical Co. under the tradename NEODOL 25-7),
- tridecylpolyethyleneoxide(12) alcohol (available from ICI Americas, Inc., under the tradename RENEX 30),
- poly(ethylene oxide)-poly(propylene oxide), and poly (ethylene oxide) di-ol (available from BASF Corp., under the tradename PLURONIC L-44), and
- nonylphenoxy poly[hydroxy propylene oxide(8–10)] (available from Olin Corp. under the tradename SURFACTANT 10G).

Preferred nonionic surfactants of this type include the TRITON brand surfactants and the NEODOL 25-7 surfactant.

Other useful materials of this type are well known in the patent and trade literature, and would therefore be readily apparent to one skilled in the art.

A second class of compounds useful as the first surfactant includes anionic non-fluorinated sulfate or sulfonates. "Anionic" means that the compounds have a net negative charge. Such compounds can be represented by the following formulae:

$$R_1—(A)—C$$

or $$(R_2)_p—(B)_y—(E)_z—C$$

wherein $R_1$ is a substituted or unsubstituted alkyl group of 8 to 20 carbon atoms (preferably 10–16 carbon atoms), A is a substituted or unsubstituted arylene or hydroxyethylene group, C is $—SO_3^-M^+$ or $—SO_4^-M^+$ wherein $M^+$ is hydrogen, or ammonium or an aLkali metal ion (such as lithium, sodium or potassium), $R_2$ is a substituted or unsubstituted alkyl group of 4 to 20 carbon atoms (preferably 4 to 16 carbon atoms), y is 0 or 1, p is 1 when y is 0, and p is 1, 2 or 3 when y is 1, B is a substituted or insubstituted phenylene group, E is $—(OCH_2CH_2)—$, and z is an integer from 1 to 8.

Such first surfactants include, but are not limited to, alkylbenzenesulfonates, 2-hydroxytetra, alkane-1-sulfonates, alkylphenoxypolyethoxysulfates, and alkylpolyethoxysulfates. Representative compounds include sodium dodecylsulfonate (available from Rhone-Poulenc as SIPONATE DS-10), sodium 2-hydroxytetra, hexadecane-1-sulfonate (available from Witco as WITCONATE AOS), sodium nonylphenoxypolyethoxy sulfate (available from Witco as WITCOLATE DS10), sodium tributyl phenoxypolyethoxysulfate (available from Hoechst Celanese as HOSTAPAL BV), sodium alkyl($C_9$–$C_{12}$)polyethyleneoxide (7)ethanesulfonate (available from PPG as AVANEL S-70), and sodium ($C_{12}$–$C_{15}$)polyethoxy(3)sulfate (available from Witco as WITCOLATE ES-3). Various useful anionic surfactants are also described in U.S. Pat. No. 5,360,700 (Kawamura et al).

The first surfactants used in the final rinse solution of this invention can include a mixture of one or more surfactants from either or both of the two classes.

The second surfactant in the final rinse solution of this invention is a nonionic or anionic fluorinated surfactant or a mixture of two or more of such compounds that are compatible in solution.

Nonionic fluorinated surfactants are also known in the art. Typically, such compounds are water-soluble or water-dispersible and have one or more fluorocarbon moieties in the molecule wherein at least one hydrogen atom has been replaced with a fluorine atom. Each fluorocarbon moiety generally has at least 4 carbon atoms and can be saturated or unsaturated.

A representative class of nonionic fluorinated surfactants has the formula:

$$R_f—CH_2CH_2O—(CH_2CH_2O)_zH$$

wherein $R_f$ is $$F—(CF_2CF_2)_{3-8}$$

and z is 4 to 20.

Representative surfactants of this type include, but are not limited to, fluoroalkylpolyethyleneoxide alcohols, such as those commercially available as ZONYL FSN, ZONYL FS 300 or ZONYL FSO from DuPont Co., or as FLUORAD FC-430 or FLUOWET OT from American Hoechst. ZONYL FSO nonionic surfactant is most preferred of this type of material.

A class of anionic fluorinated surfactants can be represented by the structure:

$$R_f—Y$$

wherein $R_f$ is defined above and is preferably mostly $C_6F_{13}^-$, $C_8F_{17}^-$ and $C_{10}F_{31}^-$ groups. Y is $—SO^-_3M^+$, $—SO^-_4M^+$ or $—CO_2^{-M+}$ wherein $M^+$ is defined above.

These anionic fluorinated surfactants can be generally described as fluoroalkylsulfonates, fluoroalkylsulfates and fluoroalkylcarboxylates. The fluoroalkylsulfonates and -sulfates are preferred.

Representative surfactants of this type include, but are not limited to, MEGAFAC F116 (perfluorooctane sulfonate, sodium salt), FLUORAD FC-95, FLUORAD PC-120 and FLUORAD FC-143 (all available from 3M Co.)

Other examples of all types of first and second surfactants that are available commercially are described by tradename and commercial source in *McCutcheon's Volume 1: Emulsifiers & Detergents*, 1993 North American Edition, McCutcheon Division, MC Publishing Co., Glen Rock, N.J.

The concentration of the one or more first surfactants in the working strength final rinse is generally at least 0.03 g/l, and preferably at least 0.05 g/l, and generally less than 5, and preferably less than 0.5 g/l. The concentration of the one or more second surfactants is generally at least 0.005 g/l, preferably at least 0.01 g/l, and generally less than 3 g/l, and preferably less than 0.1 g/l.

The weight ratio of the two types of surfactants in the solution can vary widely, but preferably, the weight ratio is from about 1000:1 to about 1:1000 (first surfactant to second surfactant). More preferably, the weight ratio is from about 30:1 to about 1:30. The ZONYL brand nonionic fluorinated surfactants generally can be used at lower concentrations.

The final rinse of this invention is different from what is known in the art as a "stabilizing" solution. Thus, the final rinse solution is completely free of dye image stabilizing compounds, both formaldehyde releasing compounds as well as those that do not release formaldehyde. The presence of a dye image stabilizing compound in the final rinse solution of this invention could adversely affect solution performance of the final rinse solution with the likelihood of increased scumming and the presence of other residue ("defects" such as lines, spots and the like) on the processed films.

While not necessary, other addenda can be included in the final rinse solution if desired, including but not limited to, biocides (such as isothiazolones, halogenated phenolic compounds, disulfide compounds and sulfamine agents), water-soluble polymers [such as poly(vinyl pyrrolidones)], water-soluble metal chelating agents (such as hydrolyzed polymaleic anhydride polymers, inorganic and organic phosphoric acids and aminopolycarboxylic acids), defoaming agents, a source of cupric ion (such as cupric nitrate) for some biocides, a source of ammonium ion (such as from common ammonium salts), a source of sulfite ion (such as from a common organic or inorganic sulfite), buffers and other materials readily apparent to one skilled in the photographic art. These optional materials can be present in conventional amounts (e.g., as described in the art cited above, including EP-A-0 530 832).

It is preferred that the final rinse solution contain a biocide such as an isothiazolone or mixture thereof, for example the commercially available KATHON LX biocide (Rohm and Haas), in conventional amounts. Poly(vinyl pyrrolidone) may also be present, if desired, in a conventional amount.

It is critical that the final rinse solution also contain one or more low molecular weight, water-soluble or water-dispersible glycols, that is glycols having a molecular weight below 400. Such compounds include, but are not limited to, ethylene glycol, propylene glycol, diethylene glycol, triethylene glycol, tetraethylene glycol and mixtures thereof. Diethylene glycol and propylene glycol are preferred with diethylene glycol being most preferred. The glycol is generally present at a concentration of at least 0.25 g/l, and preferably at least 0.5 g/l, and generally less than 20 g/l, preferably less than 15 g/l, and more preferably less than 3 g/l, in the working strength solution.

The components of the final rinse solution described herein can be mixed together in any suitable order as would be readily understood in the art, and stored indefinitely or used immediately.

The solution can also be formulated in a concentrated form for storage and transportation, then diluted from typically 30 to 120 times with water or a suitable buffer prior to or during use. Preferably, the dilution rate is from about 50 to about 70 times to provide a desired working strength solution. The level of concentration will be dependent upon the types and concentrations of the various components.

Thus, a concentrated final rinse solution of this invention can comprise three essential components:

- one or more of the first surfactants present at a concentration of from about 0.9 to about 600 g/l,
- one or more of the second surfactants present at a concentration of from about 0.15 to about 300 g/l, and
- one or more of the water-soluble or water-dispersible glycols present at a concentration of from about 7.5 to about 1000 g/l.

More preferably, the concentrated solution components are present as follows:

- one or more of the first surfactants present at a concentration of from about 1.5 to about 60 g/l,
- one or more of the second surfactants present at a concentration of from about 0.3 to about 12 g/l, and
- one or more of the water-soluble or water-dispersible glycols present at a concentration of from about 15 to about 1000 g/l.

Most preferably, the concentrated solution components are present as follows:

- one or more of the first surfactants present at a concentration of from about. 2.5 to about 35 g/l,
- one or more of the second surfactants present at a concentration of from about 0.5 to about 7 g/l, and
- one or more of the water-soluble or water-dispersible glycols present at a concentration of from about 25 to about 250 g/l.

The final rinse solution of this invention is used in the final processing step, after color development, bleaching, and fixing (or bleach-fixing), and prior to drying.

The present invention can therefore be used to process silver halide color negative films (for example, using the known PROCESS C-41), or color reversal (for, example, using the known PROCESS E-6) films, with or without a magnetic backing layer or stripe, or color papers (for example, using the known PROCESS RA-4). Preferably, color negative or color reversal films are processed using this invention. Black-and-white photographic silver halide films and papers can also be processed using the final rinse solution of this invention.

During such processing, conventional procedures can be used for replenishment of the various processing solutions, including the final rinse solution. Preferably, replenishment of the final rinse solution is not more than 700 ml/m$^2$, and preferably from about 50 to about 600 ml/m$^2$ of processed photographic film. The processing equipment can be any suitable processor having one or more processing tanks or vessels, including mini-lab processors and other larger scale processors. The final rinse step can be carried out in one or more tanks arranged in countercurrent flow, if desired.

The final rinse step can be carried out at a temperature of from about 20 to about 60° C., and for generally at least 5, and preferably at least 10 seconds, and generally less than 200, and preferably less than 60 seconds. Optimal processing conditions are at from about 27 to about 38° C. for from about 20 to about 200 seconds.

The emulsions and other components, and element structure of such photographic materials and the various steps used to process them are well known and described in considerable publications, including, for example, *Research Disclosure*, publication 38957, pages 592–639 (September 1996) and hundreds of references noted therein. *Research Disclosure* is a publication of Kenneth Mason Publications Ltd., Dudley House, 12 North Street, Emsworth, Hampshire PO10 7DQ England (also available from Emsworth Design Inc., 121 West 19th Street, New York, N.Y. 10011). This reference will be referred to hereinafter as "*Research Disclosure*". More details about such elements are provided herein below. The invention can be practiced with photographic color and black-and-white films and papers containing any of many varied types of silver halide crystal morphology, sensitizers, color couplers, and addenda known in the art, as described in the noted *Research Disclosure* publication and the many publications noted therein. The films and papers can have one or more layers, at least one of which is a silver halide emulsion layer that is sensitive to electromagnetic radiation, disposed on a suitable film support (typically a polymeric material), or resin coated paper support. Preferred films processed according to this invention are color negative films.

The processed film elements preferably have a magnetic recording layer, or stripe, on the support opposite the silver halide emulsion layer(s).

Formulations for preparing magnetic recording layers are also well known in the art, as described for example, in *Research Disclosure*, publication 34390, November, 1992, U.S. Pat. No. 5,395,743 (Brick et al), U.S. Pat. No. 5,397,826 (Wexler), and Japanese Kokai 6-289559 (published Oct. 18, 1994), all incorporated herein by reference. The magnetic recording layers generally include a dispersion of ferromagnetic particles in a suitable binder. Preferably, the binder is transparent so the layer is transparent, but this is not essential. As might be expected, it is highly desirable that the magnetic recording layer not only exhibit desired magnetic and photographic performance, but that it also be highly durable, abrasion resistant and scratch resistant.

Suitable ferromagnetic particles would be readily apparent to one skilled in the art. They include, but are not limited to, ferromagnetic iron oxides (such as g-$Fe_2O_3$ or $Fe_3O_4$) with or without cobalt, zinc or other metal dopants in solid solution or surface treated, ferromagnetic chromium dioxides with or without metallic elements or halogen atoms in solid solution, ferromagnetic chromium dioxide powders, barium ferrite and others known in the art. Ferromagnetic metal pigments with an oxide coating on their surface to improve their chemical stability or to improve dispersibility as is commonly employed in conventional magnetic recording, may also be used if desired. In addition, magnetic oxides with a thicker layer of lower refractive index oxide or other material having a lower optical scattering cross-section can be used. Cobalt doped-iron oxide is the preferred ferromagnetic material useful in the practice of this invention.

The magnetic recording layer typically contains one or more transparent binders, dispersant-cobinders, optional non-magnetic particulate materials, grind solvents, coating aids, surfactants, crosslinking agents, catalysts, and other conventional addenda for such layers. The amounts and proportions of the various components of such layers are also known in the art (see publications noted above).

While the magnetic recording layer can cover only a portion of the surface of the support generally it covers nearly the entire surface, and can be applied using conventional procedures including coating, printing, bonding or laminating.

Various supports can be used for the films processing according to this invention including the conventional acetates, cellulose esters, polyamides, polyesters, polystyrenes and others known in the art. Polyesters such as poly(ethylene terephthalate), poly(ethylene naphthalate), poly-1,4-cyclohexanetdnethylene terephthalate, polyethylene 1,2-diphenoxyethane-4,4'-dicarboxylate, and polybutylene terephthalate are preferred. These materials can be subbed or unsubbed and coated with various antihalation, antistatic or other non-imaging layers as is known in the art Particularly useful antistatic layers on the backside of the elements include vanadium pentoxide in a suitable binder.

Because the elements having a magnetic recording layer are transported in cameras and across magnetic heads, they generally have a lubricant, such as a fatty acid ester (for example, butyl stearate), applied to the magnetic recording layer to facilitate element transport. The lubricant can be in the form of a uniform coating, or present in a regular or irregular pattern. The lubricant can be a single material or a mixture of two or more materials as long as the eventual coating provides a coefficient of friction of less than about 0.5. Coefficient of friction is determined using a conventional paper clip friction test described, for example, in ANSI IT 9.4-1992. Various lubricants can be used such as silicone oils or waxes, fluorine-containing alcohols, esters or ethers, fluorinated polyalkanes, polyolefms, polyglycol alkyl phosphates or alkali metal salts thereof, polyphenyl ethers, fluorine-containing alkylsulfates or alkali metal salts thereof, monobasic fatty acids or metal salts thereof, mono- or polyvalent alcohols, alkoxy alcohols, fatty acid esters or monoalkyl ethers or alkylene oxide polymers, fatty acid amides and aliphatic amines. A preferred lubricant is commercially available carnauba wax.

Reagents and solutions for black-and-white and color development are well known, and described, for example, in *Research Disclosure* (noted above), sections XVIII and XIX, and the many references described therein. Thus, besides a developing agent (either black-and-white or color developing agent), the developers can include one or more buffers, antioxidants (or preservatives), antifoggants, solubilizing agents, brighteners, halides, sequestering agents and other conventional addenda.

Bleaching and fixing solutions and reagents are also well known, as described for example, in *Research Disclosure* (noted above), section XX and the many references noted therein. Common bleaching agents include, but are not limited to, ferric salts or ferric binary or ternary complexes of aminopolycarboxylic acids of many various structures. Fixing agents include, but are not limited to, thiosulfates. Various bleaching and fixing accelerators are also known.

Processing steps and solutions specific to processing color negative films (for example, PROCESS C-41) and color reversal films (for example, PROCESS E-6) are known in the art.

Processing according to the present invention can be carried out using conventional deep tanks holding processing solutions. Alternatively, it can be carried out using what is known in the art as "low volume thin tank" processing systems using either rack and tank, roller transport or automatic tray designs. Such processing methods and equipment are described, for example, in U.S. Pat. No. 5,436,118 (Carli et al) and publications cited therein.

The following examples are included for illustrative purposes only. Unless otherwise indicated, the percentages are by weight.

MATERIALS AND METHODS FOR EXAMPLES

In the following Examples 1–3, film samples (three replicates of each solution for each film) were processed using the following protocol:

| | | |
|---|---|---|
| Color development | 195 sec. | 37–38° C. |
| Bleaching | 390 sec. | 35–41° C. |
| Washing | 195 sec. | 24–41° C. |
| 1st fixing | 195 sec. | 35–41° C. |
| 2nd fixing | 195 sec. | 35–41° C. |
| Washing | 195 sec | 24–41° C. |
| Final Rinsing | 98–195 sec. | 24–41° C. |
| Drying | ~26 minutes | 37–38° C. |

The recommended commercially available Kodak PROCESS C-41 solutions (KODAK FLEXICOLOR Developer, KODAK FLEXICOLOR Bleach and Replenisher, and KODAK FLEXICOLOR Fixer and Replenisher) for color development, bleaching and fixing were used in all examples utilizing a commercially available Refrema rack and tank processor (Model C-41-90-GL-V-ESS).

A conventional acetate base 135 format color negative photographic film having no magnetic backing layer was used in the following examples (commercially available KODAK GOLD 200 Film, 5282, identified as Film A). A conventional magnetic backed color negative photographic film was also used in the examples (KODAK ADVANTIX 100 Film, 5194, identified as Film B) the components of which are described in considerable detail in U.S. Pat. No. 5,395,743 (Brick et al) and U.S. Pat. No. 5,397,826 (Wexler) and *Research Disclosure*, publication 34390, November 1992. All film samples were uniformly exposed (fogged) under room light.

The processed film samples were examined for residue after the final rinsing step by viewing the base-side under a halogen specular light source (Sunnex Model 703-27 with a 20 watt halogen lamp and frosted lens) positioned about 15 cm from the film sample. The amount of observed residue was rated on a scale of "1" to "4" using the following criteria:

| RATING VALUE | MEANING |
|---|---|
| 1 | No observable residue under specular light, or normal room lights |
| 2 | Residue easily observed under specular light, but not under normal room lights |
| 3 | Residue observed under both normal lights |
| 4 | A very heavy residue deposit easily observed under both room lights |

Film samples that did not fit exactly into the above ratings were given intermediate (½) ratings between the two most appropriate numbers.

FINAL RINSE FORMULATIONS

The film samples were processed using a conventional Refrema Model C-41-90-GL-V-ESS rack and tank processor. The following final rinse solutions (A-O) were used in the various Examples:

A: ZONYL FSO nonionic surfactant (0.025 g/l), NEODOL 25-7 nonionic surfartant (0.2 g/l), KATHON LX biocide (0.01 g/l), and cupric nitrate (0.001 g/l). pH=7.8

B: Same as solution A with the addition of propylene glycol (0.45 g/l). pH=7.8

C: Same as solution A with the addition of propylene glycol (0.9 g/l). pH=7.8

D: Same as solution A with the addition of propylene glycol (1.8 g/l). pH=7.8

E: Same as solution A with the addition of diethylene glycol (0.45 g/l). pH=8.0

F: Same as solution A with the addition of diethylene glycol (0.9 g/l). pH=8.0

G: Same as solution A with the addition of diethylene glycol (1.8 g/l). pH=8.0

H: Same as solution A with the addition of polyethylene glycol (mol. wt. of about 350, Carbowax 350, 0.5 g/l). pH=7.6–7.9

I: Same as solution A with the addition of polyethylene glycol (Carbowax 350, 1 g/l). pH=7.6–7.9

J: Same as solution A with the addition of polyethylene glycol (Carbowax 350, 1.5 g/l). pH=7.6–7.9

K: Same as solution with the addition of polyethylene glycol (mol. wt. of about 1450, Carbowax 1450, 0.5 g/l). pH=7.6–7.9

L: Same as solution A with the addition of polyethylene glycol (Carbowax 1450, 1.5 g/l). pH=7.6–7.9

M: Commercially available KODAK Final Rinse and Replenisher, PROCESS E-6. pH=8.2

N: Same as solution A with the addition of propylene glycol (1.2 g/l). pH=7.6

O: Same as solution A with the addition of diethylene glycol (1.2 g/l). pH=7.6

EXAMPLE 1

Processing Methods Using Final Rinse Solutions A-G

This example compares use of Solution A with other similar final rinse solutions that also contain a glycol, either propylene glycol or diethylene glycol. Fully exposed (fogged) samples of Films A and B were processed using the protocol described above and the solutions shown in TABLE I below. The evaluations of residue on each film sample replicate is also in TABLE I.

TABLE I

| Final Rinse Solution | Residue Evaluation Film A | Film B | Observations |
|---|---|---|---|
| A | 1.5 | 2 | Thin drying lines near |
| (Control) | 1.5 | 2 | edges |
| | 1.5 | 2 | |
| B | 1.5 | 1.5 | A few thin drying lines |
| | 1.5 | 1.5 | near edge of Film A |
| | 1.5 | 1 | |
| C | 1 | 1 | |
| | 1 | 1 | |
| | 1.5 | 1 | |
| D | 1 | 1 | |
| | 1 | 1 | |
| | 1 | 1 | |
| E | 1.5 | 1 | A few thin hazy (ill- |
| | 1.5 | 1 | defined) drying lines near |
| | 1.5 | 1 | edges on Film A |
| F | 1 | 1 | |
| | 1 | 1 | |
| | 1.5 | 1 | |
| G | 1 | 1 | |
| | 1 | 1 | |
| | 1 | 1 | |

Test results with both Films A and B showed a definite reduction in base-side processing defects (for example, scum residue and drying lines) as the level of propylene glycol or diethylene glycol was increased.

EXAMPLE 2

Processing Methods Using Final Rinse Solutions A and H-L

This example was carried out similarly to Example 1 but the final rinse solutions of the invention contained a polyethylene glycol, i.e. a polymeric glycol. TABLE II below shows the results.

TABLE II

| Final Rinse Solution | Residue Evaluation Film A | Film B | Observations |
|---|---|---|---|
| A | 1.5 | 2 | Thin drying lines near |
| (Control) | 1.5 | 2 | edges of films |
| | 1.5 | 2 | |
| H | 1.5 | 2 | A few thin drying |
| | 1.5 | 2 | lines near edges |
| | 1.5 | 2 | |
| I | 1.5 | 1.5 | A few thin drying |
| | 1.5 | 1.5 | lines near edges |
| | 1.5 | 1.5 | |
| J | 1 | 1.5 | |
| | 1 | 1 | |
| | 1 | 1 | |
| K | 1.5 | 1.5 | A few thin drying |
| | 1.5 | 1.5 | lines near edges |
| | 1.5 | 1.5 | |
| L | 1 | 1 | |
| | 1 | 1 | |
| | 1 | 1 | |

A slight improvement was observed with the inclusion of the polyethylene glycol in the final rinse solution, but the improvements in reduced scum residue and drying lines were most dramatic at the highest concentration (1.5 g/l).

EXAMPLE 3

Processing of Reversal Film

This example shows the practice of this invention to process reversal color films using the following processing protocol:

| | | |
|---|---|---|
| First development | 360 sec. | 37–38° C. |
| Washing | 120 sec. | 37–38° C. |
| Reversal bath | 120 sec. | 37–38° C. |
| Color development | 360 sec. | 37–38° C. |
| Prebleaching | 120 sec. | 37–38° C. |
| Bleaching | 360 sec. | 37–38° C. |
| Washing | 120 sec. | 37–38° C. |
| 1st fixing | 120 sec. | 37–38° C. |
| 2nd fixing | 120 sec. | 37–38° C. |
| Washing | 120 sec. | 37–38° C. |
| Final Rinsing | 120 sec. | 37–38° C. |
| Drying | 29 minutes | 56° C. |

The recommended commercially available Kodak PROCESS E-6AR solutions (KODAK Developer Replenisher, KODAK Reversal Bath Replenisher, KODAK Color Developer LORR, KODAK Prebleach II and Replenisher, KODAK Bleach and Replenisher, KODAK Fixer and Replenisher, and KODAK Final Rinse and Replenisher) for black and white first development, reversal bath treatment, color development, prebleaching, bleaching, fixing and final rinsing were used utilizing a commercially available Refrema rack and tank processor (Model E6-150-GL-VESS).

A conventional acetate base 135 format color reversal photographic film having no magnetic backing layer was used in the following examples (commercially available KODAK E100S Film, 5089, identified as Film C). A magnetic backed color reversal film was also used in the examples (identified as Film D) the components of which are described in considerable detail in U.S. Pat. No. 5,395,743 (Brick et al) and U.S. Pat. No. 5,397,826 (Wexler) and *Research Disclosure*, publication 34390, November 1992.

The processed film samples were examined for residue and rated as described in Examples 1 and 2. The results are shown in TABLE III below.

TABLE III

| Final Rinse Solution | Residue Evaluation Film C | Film D | Observations |
|---|---|---|---|
| M | 2 | 1 | Thin hazy (ill-defined) drying |
| (Control) | 1.5 | 2 | lines near edges of films |
| | 2 | 1.5 | |
| N | 1 | 1 | |
| | 1 | 1 | |
| | 1 | 1 | |
| O | 1 | 1 | |
| | 1 | 1 | |
| | 1 | 1 | |

The final rinse solutions of the invention (solutions N and O) provided a dramatic reduction in base-side processing defects (scum residue and drying lines) over the commercially available final rinse solution used for Process E-6. Another advantage with the present is that the same final rinse solution can be used for processing both color negative and color reversal films.

EXAMPLE 4

Preparation of a Concentrate

This example demonstrates a concentrate final rinse solution of this invention. This concentrate is a 55.6× concentrate of a preferred working strength solution (that is, 18 ml concentrate to make 1 liter of solution).

| One liter of concentrate includes the following (pH = 4.2): | |
|---|---|
| ZONYL FSO nonionic surfactant | 1.39 g/l |
| NEODOL 25-7 nonionic surfactant | 11.11 g/l |
| KATHON LX biocide | 0.556 g/l |
| Copper nitrate | 0.056 g/l |
| Diethylene glycol | 66.67 g/l |

EXAMPLE 5

Reversal Processing Comparing the Use of Solutions A, D & G

This example used the protocol of Example 3, with the use of final rinse solutions A, D and G. Films were exposed, processed and evaluated as in Example 3. The results are shown in Table IV below.

TABLE IV

| | Residue Evaluation | | |
|---|---|---|---|
| Final Rinse Solution | Film C | Film D | Observations |
| A | 1.5 | 2 | Very thin drying lines of residue having ill-defined edges on Film C; slightly heavier lines on Film D |
| (Control) | 1.5 | 2 | |
| | 1.5 | 2 | |
| D | 1 | 1 | |
| | 1 | 1 | |
| | 1 | 1 | |
| G | 1 | 1 | |
| | 1 | 2* | |
| | 1 | 1 | |

*Film sample was improperly mounted, causing it to be twisted during processing, resulting in an uncharacteristic diagonal line of residue in the center of the film sample.

The use of final rinse solutions D and G provided a significant reduction in base-side processing defects (scum, drying lines, spots) over the use of solution A.

The invention has been described in detail with particular reference to preferred embodiments thereof, but it will be understood that variations and modifications can be effected within the spirit and scope of the invention.

We claim:

1. A photographic final rinse solution that is free of dye image stabilizing compounds and comprises:

a) a first surfactant that is:

a nonionic polyethoxylated, non-fluorinated surfactant, or an anionic non-fluorinated sulfate or sulfonatc surfactant, said first surfactant being present at a concentration of at least 0.03 g/l, and b) a second surfactant that is a nonionic or anionic fluorinated surfactant present at a concentration of at least 0.005 g/l, and c) a water-soluble or water-dispersible glycol present in a concentration of at least 0.25 g/l.

2. The solution of claim 1 wherein said first surfactant is a nonionic polyethoxylated, non-fluorinated surfactant that has the general formula (I):

$$R—(B)_x—(E)_n—D$$

wherein R is alkyl having 8 to 20 carbon atoms, B is phenylene, x if 0 or 1, E is $—(OCH_2CH_2)—$, n is an integer of 6 to 20, and D is hydroxy or methoxy.

3. The solution of claim 2 wherein said polyethoxylated non-fluorinated surfactant is octylphenoxypoly(ethyleneoxide)(9) ethanol, octylphenoxypoly(ethyleneoxide)(12) ethanol, octylphenoxypoly-(ethyleneoxide)(30–40) ethanol, alkyl($C_{12-15}$ mixture) poly(ethyleneoxide)(7) alcohol, tridecylpolyethyleneoxide(12), poly(ethylene oxide)-poly(propylene oxide), poly(ethylene oxide) di-ol, or nonylphenoxy poly[hydroxy propylene oxide(8–10)].

4. The solution of claim 1 wherein said first surfactant is an anionic non-fluorinated sulfate or sulfonate surfactant represented by the formula:

$$R_3—(A)—C$$

or $$(R_4)_p—(B)_y—(E)_z—C$$

wherein $R_3$ is an alkyl group of 8 to 20 carbon atoms, A is an arylene or hydroxyethylene group, C is $—SO_3^-M^+$ or $—SO_4^{-M+}$ wherein $M^+$ is hydrogen, or ammonium or an alkali metal ion, $R_4$ is an alkyl group of 4 to 20 carbon atoms, y is 0 or 1, p is 1 when y is 0, and p is 1, 2 or 3 when y is 1, B is a phenylene group, E is $—(OCH_2CH_2)—$, and z is an integer from 1 to 8.

5. The solution of claim 1 wherein said first surfactant is an alkylbenzenesulfonate, a 2-hydroxytetra, alkane-1-sulfonate, an alkylphenoxypolyethoxysulfate, or an alkylpolyethoxysulfate.

6. The solution of claim 1 wherein said second surfactant is an anionic fluorinated surfactant that is a fluoroalkylsulfonate, fluoroalkylsulfate or fluoroalkylcarboxylate.

7. The solution of claim 6 wherein said second surfactant is a sodium or potassium perfluorooctane sulfonate.

8. The solution of claim 1 wherein said second surfactant is a nonionic fluorinated surfactant having the formula:

$$R_f—CH_2CH_2O—(CH_2CH_2O)_z—H$$

wherein $R_f$ is $$F—(CF_2CF_2)_{3-8}$$

and z is 4 to 20.

9. The solution of claim 1 wherein the concentration of said first surfactant is from about 0.03 to about 5 g/l, and the concentration of said second surfactant is from about 0.005 to about 3 g/l, and the weight ratio of said first surfactant to said second surfactant is from about 1:1000 to about 1000:1.

10. The solution of claim 9 wherein the concentration of said first surfactant is from about 0.05 to about 0.5 g/l, the concentration of said second surfactant is from about 0.01 to about 0.1 g/l, and the weight ratio of said first surfactant to said second surfactant is from about 1:30 to about 30:1.

11. The solution of claim 1 wherein said glycol is present at a concentration of from about 0.25 to 20 g/l.

12. The solution of claim 11 wherein said glycol is present at a concentration of from about 0.5 to about 15 g/l.

13. The solution of claim 1 wherein said glycol is propylene glycol, diethylene glycol, triethylene glycol, tetraethylene glycol, ethylene glycol, or a mixture of any of these.

14. A concentrated photographic final rinse solution that is free of dye image stabilizing compounds and comprises:

a) a first surfactant that is:

a nonionic polyethoxylated, non-fluorinated surfactant, or an anionic non-fluorinated sulfate or sulfonate surfactant, said first surfactant being present at a concentration of from about 0.9 to about 600 g/l, b) a second surfactant that is a nonionic or anionic fluorinated surfactant present at a concentration of from about 0.15 to about 300 g/l, and c) a water-soluble or water-dispersible glycol present in a concentration of from about 7.5 to about 1000 g/l.

15. The concentrate of claim 14 wherein:

said first surfactant is present at a concentration of from about 1.5 to about 60 g/l, said second surfactant is present at a concentration of from about 0.3 to about 12 g/l, and said glycol is present at a concentration of from about 15 to about 1000 g/l.

16. The concentrate of claim 14 wherein:

said first surfactant is present at a concentration of from about 2.5 to about 35 g/l, said second surfactant is present at a concentration of from about 0.5 to about 7 g/l, and said glycol is present at a concentration of from about 25 to about 250 g/l.

17. The concentrated solution of claim 14 wherein said first surfactant is a nonionic polyethoxylatcd, non-fluorinated surfactant that has the general formula (I):

$$R—(B)_x—(E)_n—D$$

wherein R is alkyl having 8 to 20 carbon atoms, B is phenylene, x if 0 or 1, E is —$(OCH_2CH_2)$—, n is an integer of 6 to 20, and D is hydroxy or methoxy.

18. The concentrated solution of claim 17 wherein said polyethoxylated non-fluorinated surfactant is octylphenoxypoly(ethyleneoxide)(9) ethanol, octylphenoxypoly(ethylencoxidc)(12) ethanol, octylphenoxypoly-(ethyleneoxide)(30–40) ethanol, alkyl ($C_{12-15}$ mixture) poly(ethylencoxide)(7) alcohol, tridecylpolyethyleneoxide(12), poly(ethylene oxide)-poly (propylene oxide), poly(ethylene oxide) di-ol, or nonylphenoxy poly[hydroxy propylene oxide(8–10)].

19. The concentrated solution of claim 14 wherein said first surfactant is an anionic non-fluorinated sulfate or sulfonate surfactant represented by the formula:

$$R_3—(A)—C$$

or $$(R_4)_p—(B)_y—(E)_z—C$$

wherein $R_3$ is an alkyl group of 8 to 20 carbon atoms, A is an arylene or hydroxyethylene group, C is —$SO_3^-M^+$ or —$SO_4^-M^+$ wherein $M^+$ is hydrogen, or ammonium or an alkali metal ion, $R_4$ is an alkyl group of 4 to 20 carbon atoms, y is 0 or 1, p is 1 when y is 0, and p is 1, 2 or 3 when y is 1, B is a phenylene group, E is —$(OCH_2CH_2)$—, and z is an integer from 1 to 8.

20. The concentrated solution of claim 14 wherein said first surfactant is an alkylbenzenesulfonate, a 2-hydroxytetra, alkane-1-sulfonate, an alkylphenoxypolyethoxysulfate, or an alkylpolyethoxysulfate.

21. The concentrated solution of claim 1 wherein said second surfactant is an anionic fluorinated surfactant that is a fluoroalkylsulfonate, fluoroalkylsulfate or fluoroalkylcarboxylate.

22. The concentrated solution of claim 21 wherein said second surfactant is a sodium or potassium perfluorooctane sulfonate.

23. The concentrated solution of claim 14 wherein said second surfactant is a nonionic fluorinated surfactant having the formula:

$$R_f—CH_2CH_2O—(CH_2CH_2O)_z—H$$

wherein $R_f$ is $$F—(CF_2CF_2)_{3-8}$$

and z is 4 to 20.

24. The concentrated solution of claim 14 wherein said glycol is propylene glycol, diethylene glycol, triethylene glycol, tetraethylene glycol, ethylene glycol, or a mixture of any of these.

* * * * *